US008025530B2

(12) United States Patent
Abramov

(10) Patent No.: US 8,025,530 B2
(45) Date of Patent: Sep. 27, 2011

(54) METHOD AND APPARATUS INVOLVING A HOUSING WITH A SEALED ELECTRICAL CONNECTOR

(75) Inventor: Sergei Abramov, Sunnyvale, CA (US)

(73) Assignee: Savi Technology, Inc., Mountain View, CA (US)

( * ) Notice: Subject to any disclaimer, the term of this patent is extended or adjusted under 35 U.S.C. 154(b) by 0 days.

(21) Appl. No.: 12/501,186

(22) Filed: Jul. 10, 2009

(65) Prior Publication Data

US 2010/0009570 A1 Jan. 14, 2010

Related U.S. Application Data

(60) Provisional application No. 61/080,400, filed on Jul. 14, 2008.

(51) Int. Cl.
*H01R 13/40* (2006.01)

(52) U.S. Cl. ..... 439/587

(58) Field of Classification Search ..... 439/587, 439/271–277, 578, 322
See application file for complete search history.

(56) References Cited

U.S. PATENT DOCUMENTS

| | | | | | |
|---|---|---|---|---|---|
| 2,513,080 | A | * | 6/1950 | Burtt | 439/322 |
| 3,321,732 | A | * | 5/1967 | Forney, Jr. | 439/322 |
| 3,646,502 | A | * | 2/1972 | Hutter et al. | 439/322 |
| 3,675,185 | A | * | 7/1972 | Ruehlemann et al. | 439/564 |
| 3,744,011 | A | * | 7/1973 | Blanchenot | 439/584 |
| 3,781,762 | A | * | 12/1973 | Quackenbush | 439/322 |
| 4,290,663 | A | * | 9/1981 | Fowler et al. | 439/607.52 |
| 4,531,805 | A | * | 7/1985 | Werth | 439/607.27 |
| 4,726,788 | A | * | 2/1988 | F'Geppert | 439/551 |
| 4,998,894 | A | * | 3/1991 | Gronvall | 439/521 |
| 5,139,431 | A | * | 8/1992 | Saitoh et al. | 439/364 |
| 5,277,610 | A | | 1/1994 | Krehbiel et al. | |
| 5,439,386 | A | * | 8/1995 | Ellis et al. | 439/322 |
| 5,487,680 | A | * | 1/1996 | Yamanashi | 439/552 |
| 5,520,976 | A | * | 5/1996 | Giannetti et al. | 428/36.3 |
| 5,743,764 | A | * | 4/1998 | Czeschka et al. | 439/607.31 |
| 5,775,944 | A | * | 7/1998 | Flask et al. | 439/556 |
| 5,801,441 | A | * | 9/1998 | DiStefano et al. | 257/696 |
| 6,164,997 | A | * | 12/2000 | Davies | 439/320 |

(Continued)

FOREIGN PATENT DOCUMENTS

DE 37 28 456 A1 3/1989

(Continued)

OTHER PUBLICATIONS

Data sheet, "IP68 USB Circular SCPU, SCRUS Series", Samtec USA, New Albany, Indiana, 1 page, date unknown.

(Continued)

*Primary Examiner* — Michael C Zarroli
*Assistant Examiner* — Vladimir Imas
(74) *Attorney, Agent, or Firm* — Hayes and Boone, LLP

(57) ABSTRACT

A method and apparatus involve: configuring a wall portion to have an opening therethrough and to have a first annular surface extending around the opening; supporting on a circuit board an electrical connector having a plurality of electrical contacts and having a second annular surface; and resisting fluid flow from one side of the wall portion to an opposite side thereof through the opening, including compressing between the first and second annular surfaces a seal ring having third and fourth annular surfaces that respectively engage the first and second annular surfaces, the electrical contacts each having a portion that is accessible through the opening.

20 Claims, 9 Drawing Sheets

U.S. PATENT DOCUMENTS

| | | | | |
|---|---|---|---|---|
| 6,608,960 | B2 * | 8/2003 | Cairns et al. | 385/138 |
| 6,733,336 | B1 * | 5/2004 | Montena et al. | 439/578 |
| 6,835,094 | B2 * | 12/2004 | Matsushita | 439/559 |
| 6,884,113 | B1 * | 4/2005 | Montena | 439/578 |
| 7,033,193 | B2 * | 4/2006 | Higgins et al. | 439/277 |
| 7,097,500 | B2 * | 8/2006 | Montena | 439/587 |
| 7,128,603 | B2 * | 10/2006 | Burris et al. | 439/578 |
| 7,255,585 | B2 * | 8/2007 | Kameyama et al. | 439/271 |
| 7,341,484 | B2 * | 3/2008 | Yamamoto | 439/587 |
| 7,563,127 | B2 * | 7/2009 | Kurahashi | 439/474 |
| 2003/0017728 | A1 | 1/2003 | Ogawa | |
| 2005/0037651 | A1 * | 2/2005 | Axenbock et al. | 439/271 |
| 2007/0066088 | A1 * | 3/2007 | Rambosek et al. | 439/37 |

FOREIGN PATENT DOCUMENTS

| | | | |
|---|---|---|---|
| EP | 0 961 368 | A2 | 12/1999 |
| WO | WO 2007/016956 | A1 | 2/2007 |
| WO | WO 2007/046770 | A1 | 4/2007 |

OTHER PUBLICATIONS

Data sheet, "IP68 Sealed—Mini USB Buccaneer", Bulgin, Elektron Components Corporation, Thousand Palms, California, 2 pages, date unknown.

Data sheet, "USB On-The-Go (OTG) Mini-B Receptacle, Vertical, Through Hole Solder . . . ", Molex Incorporated, Lisle, Illinois, 2 pages, printed May 23, 2008.

PCT Search Report (PCT/ISA/220 and 210) and Written Opinion (PCT/ISA/237) dated Oct. 16, 2009 for PCT Application No. PCT/US2009/050404, 13 pages.

PCT International Preliminary Report on Patentability mailed Jan. 27, 2011, in related International Appl. No. PCT/US2009/050404.

* cited by examiner

METHOD AND APPARATUS INVOLVING A HOUSING WITH A SEALED ELECTRICAL CONNECTOR

This application claims the priority under 35 U.S.C. §119 of provisional application No. 61/080,400 filed Jul. 14, 2008, the disclosure of which is hereby incorporated herein by reference.

FIELD OF THE INVENTION

This invention relates in general to a housing with an externally accessible electrical connector and, more particularly, to techniques for providing a seal between the interior and exterior of the housing in the region of the connector.

BACKGROUND

There are a variety of applications where a device has a housing with electrical circuitry therein, and is used in an environment that includes exposure to one or more environmental conditions such as dust, grease, moisture, snow, pressurized water, high humidity, or temperature extremes. It is often necessary to provide an electrical connector that is electrically coupled to the circuitry within the housing, and that is accessible from externally of the housing. It is desirable that fluids, moisture and/or environmental contaminants be prevented from entering the housing through or adjacent the connector. Although pre-existing techniques for providing a sealed electrical connector have been generally adequate for their intended purposes, they have not been satisfactory in all respects.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
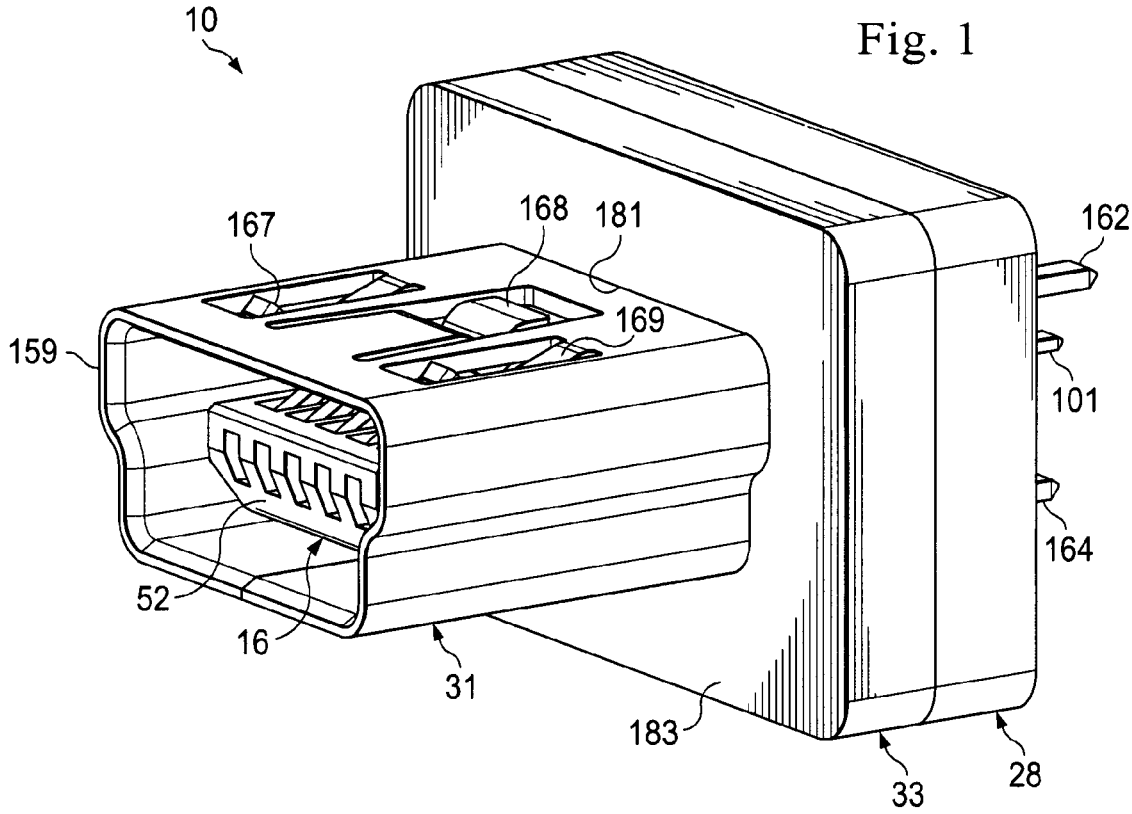
FIG. 1 is a diagrammatic perspective front view of a sealed electrical connector.

FIG. 1 is a diagrammatic perspective front view of a sealed electrical connector 10 having a portion that can be mechanically and electrically coupled to a standard and not-illustrated miniature Universal Serial Bus (mini-USB) type B connector. The term "connector" is used generically herein, and encompasses either a male connector or a female receptacle, as well as other possible connector configurations. As one example, the connector could be a micro-USB connector rather than a mini-USB connector.

Figure 2:
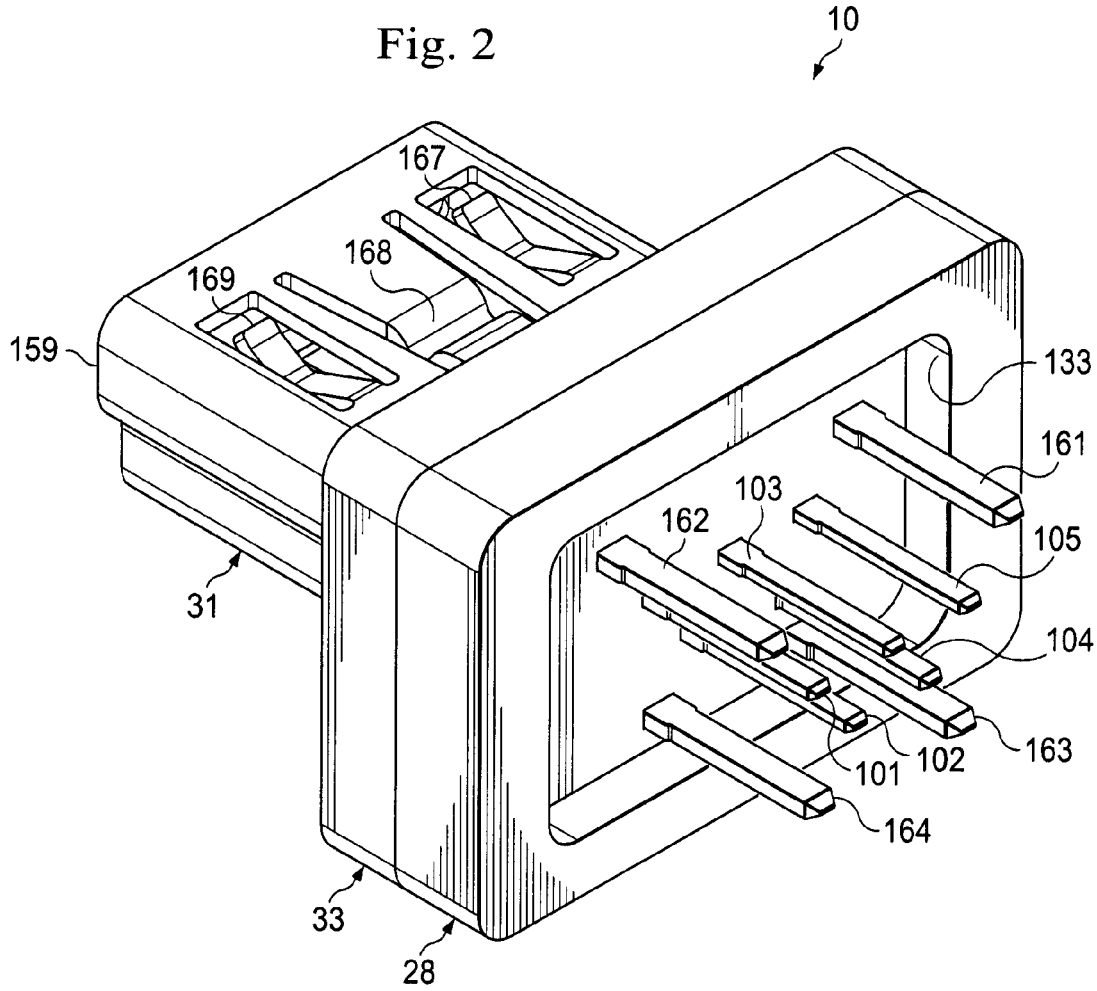
FIG. 2 is a diagrammatic perspective rear view of the connector of FIG. 1.
Figure 3:
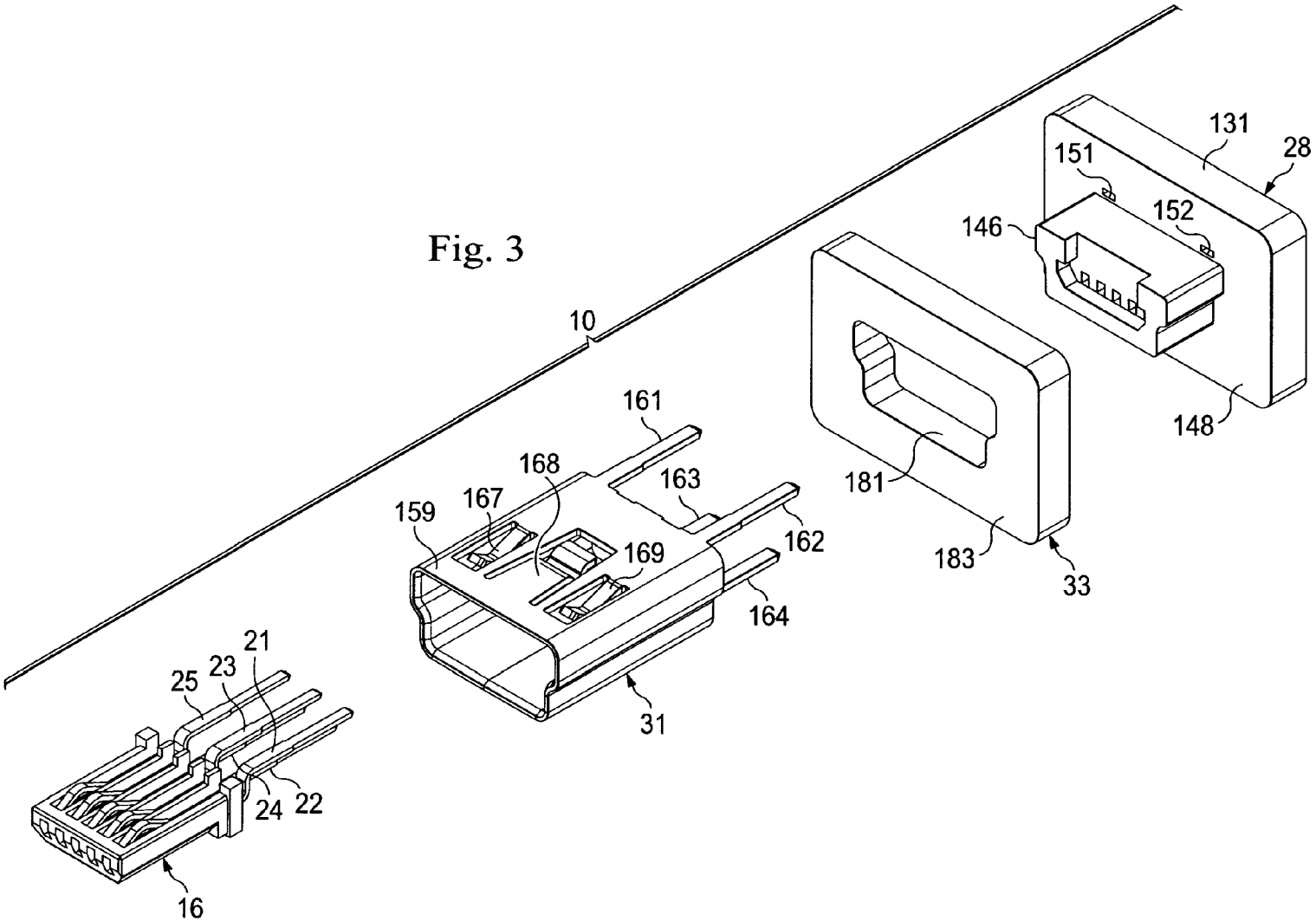
FIG. 3 is a diagrammatic exploded perspective front view of the connector of FIG. 1.
Figure 4:
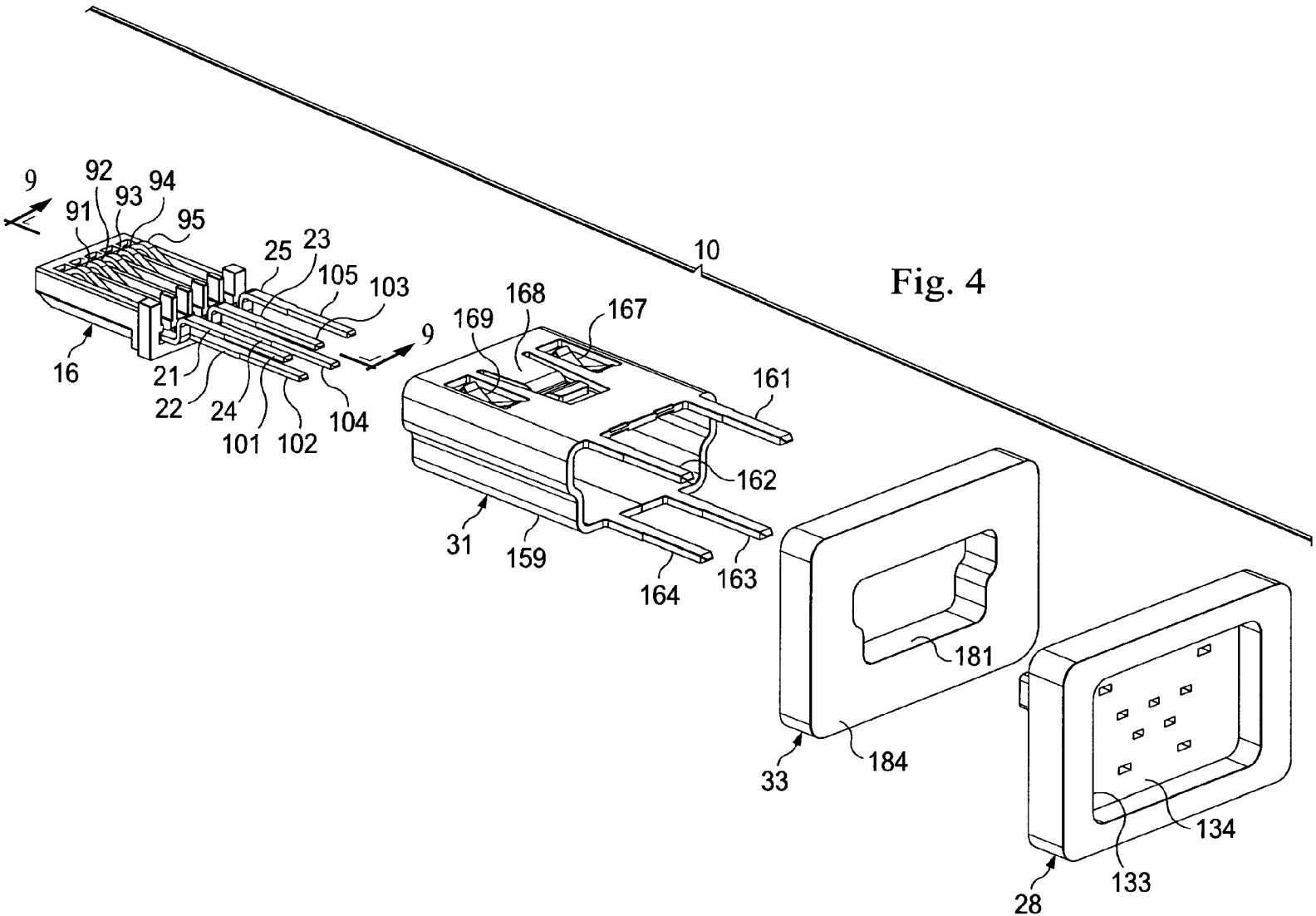
FIG. 4 is a diagrammatic exploded perspective rear view of the connector of FIG. 1.

FIG. 2 is a diagrammatic perspective rear view of the connector 10 of FIG. 1. FIG. 3 is a diagrammatic exploded perspective front view of the connector 10 of FIG. 1. FIG. 4 is a diagrammatic exploded perspective rear view of the connector 10 of FIG. 1. With reference to FIGS. 1-4, the connector 10 includes a support member 16, five electrically conductive elements 21-25, an overmold 28, a shield 31, and a gasket 33.

Figure 5:
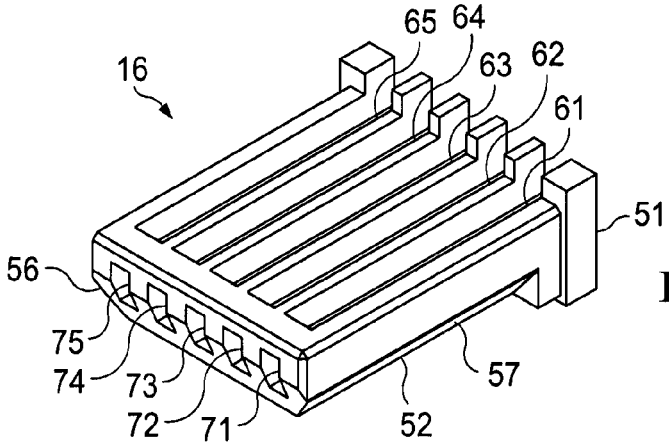
FIG. 5 is a diagrammatic perspective front view of a support member that is a component of the connector of FIG. 1.
Figure 6:
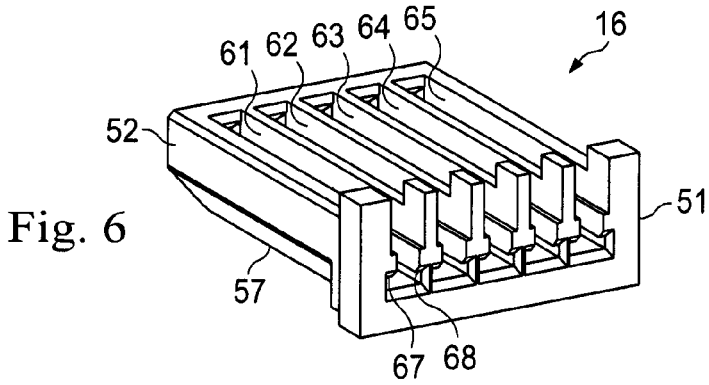
FIG. 6 is a diagrammatic perspective rear view of the support member of FIG. 5.

FIG. 5 is a diagrammatic perspective front view of the support member 16. FIG. 6 is a diagrammatic perspective rear view of the support member 16. The support member 16 is made of an electrically insulating material. In the disclosed embodiment, the support member 16 is made from a liquid crystal polymer (LCP) material that is available commercially under the tradename VECTRA® E130i™ from Ticona of Florence, Ky. Alternatively, however, the support member 16 could be made of any other suitable material. As shown in FIGS. 5 and 6, the support member 16 has a platelike and approximately rectangular base 51, and an elongate projection 52 that extends outwardly from one side of the base. The projection 52 has a cross-sectional shape that is approximately rectangular, except that the lower edges of the projection 52 are each beveled at 56 and 57.

The support member 16 has five parallel slots or channels 61, 62, 63, 64 and 65 therein. The channels 61-65 each open upwardly through top surfaces of the support member 16, and each open rearwardly through a rear surface of the support member. The channels 61-65 each extend most of the length of the projection 52, but stop short of the outer end of the projection. The channels 61-65 each have a pair of downwardly facing shoulders that extend the length thereof, as shown at 67 and 68 in FIG. 6 for the channel 61. Each of the channels 61-65 has, on each side thereof and below the shoulders 67 and 68, a pair of horizontally-spaced bosses that are not visible in the drawings. The projection 52 has five openings 71-75 that are each of rectangular cross-section, that each have one end opening through the outer end of the projection 52, and that each have another end opening into a respective one of the channels 61-65.

Figure 7:
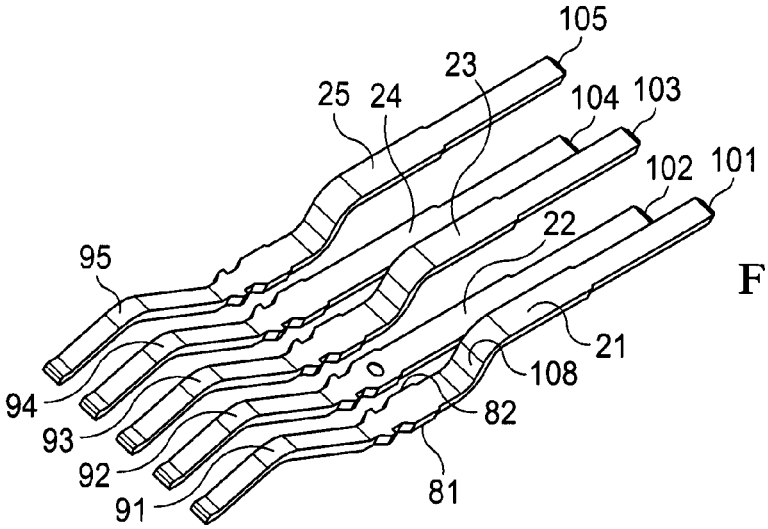
FIG. 7 is a diagrammatic perspective view of five electrically conductive elements that are components of the connector of FIG. 1.

FIG. 7 is a diagrammatic perspective view of the five conductive elements 21-25. In the disclosed embodiment, the elements 21-25 are each made from bronze, but they could alternatively be made from any other suitable material that is electrically conductive. The conductive elements are resiliently flexible. Each of the conductive elements 21-25 is flat and elongate. Each has a horizontal central section with two laterally outward projections disposed on opposite sides thereof, for example as shown at 81 and 82 for the conductive element 21. The conductive element 21 has an end section 91 with an inverted V shape, in that it extends upwardly away from the central section, and then downwardly toward its outer end. The conductive elements 22-25 have similar end sections 92-95, respectively. The end sections 91-95 each serve as an electrical contact, and are sometimes referred to herein as contacts.

At their opposite ends, the conductive elements 21-25 have respective end sections 101-105 that extend horizontally outwardly. The end sections 101-105 each serve as an electrical lead, and are sometimes referred to herein as leads. The conductive element 21 has an S-shaped bend 108 located between the end section 101 and the central section with projections 81 and 82. The conductive elements 23 and 25 have similar bends. In contrast, the conductive elements 22 and 24 do not have bends comparable to the bend 108, but instead extend horizontally outwardly from their central sections to their end sections 102 and 104.

Figure 8:
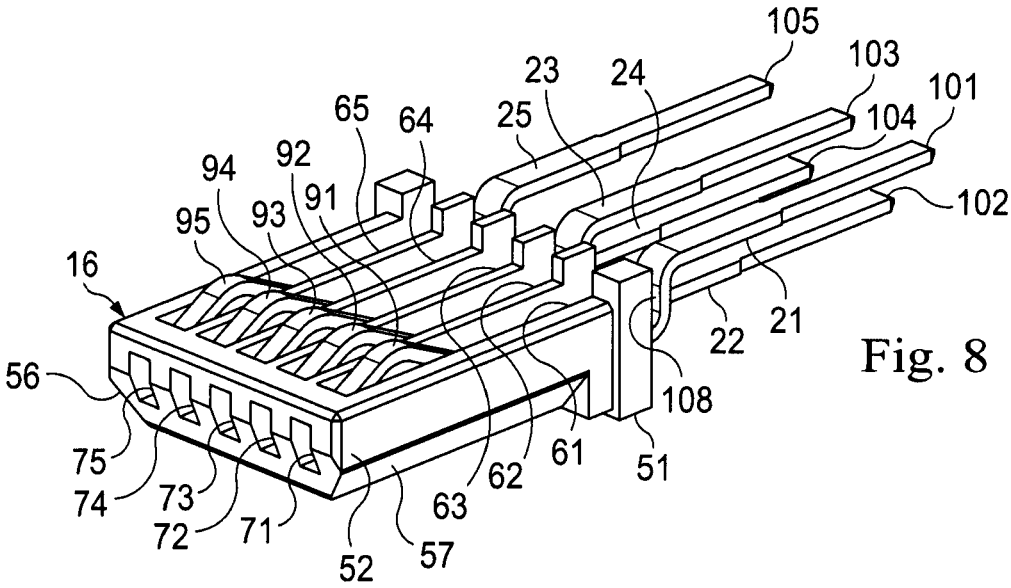
FIG. 8 is a diagrammatic perspective view showing the five conductive elements of FIG. 7 installed in the support member of FIGS. 5-6.

FIG. 8 is a diagrammatic perspective view showing the five conductive elements 21-25 installed in the support member 16. As discussed above in association with FIG. 7, the conductive element 21 has a central section with outward projections 81 and 82. This central section is disposed in the lower portion of the channel 61, below the shoulders 67 and 68 (FIG. 6). As discussed above, the channel 61 has on each side thereof, below the shoulder 67 or 68, a pair of horizontally-spaced bosses that are not visible in the drawings. The projections 81 and 82 on the conductive member 21 are each disposed between a respective pair of the bosses in the channel 61. The bosses cooperate with the projections 81 and 82 so as to prevent the central section of the conductive element 21 from moving lengthwise within the channel. The shoulders 67 and 68 engage the top sides of the projections 81 and 82, so as to prevent the central section of the conductive element 21 from moving upwardly within the channel 61. In a similar manner, the central sections of the conductive elements 22-25 are each held in place in a respective one of the channels 62-65.

Figure 9:
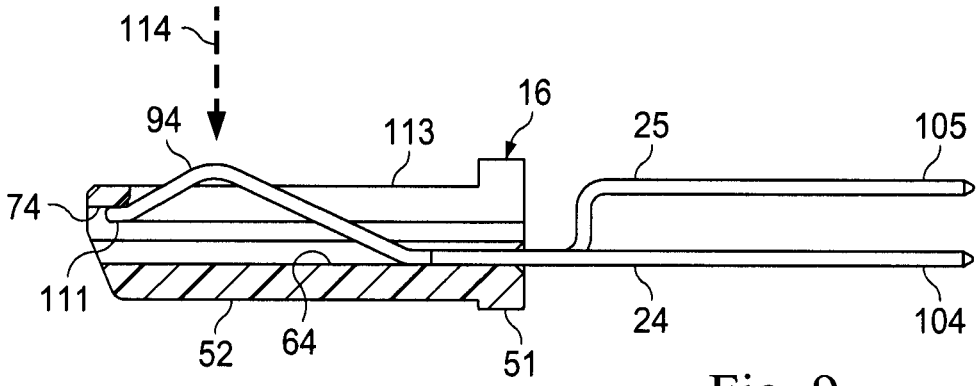
FIG. 9 is a diagrammatic sectional view taken along the section line 9-9 in FIG. 4.

FIG. 9 is a diagrammatic sectional view taken along the section line 9-9 in FIG. 4. As discussed above, the conductive element 24 has an end section 94 with an inverted V-shape that serves as an electrical contact. The end section 94 has an outer end 111 that is vertically movably received within the opening 74 in the support member 16. The inherent resilience of the support member 24 urges the end section 94 upwardly. Engagement of the outer end 111 with the top surface in the opening 74 limits upward movement of the end section 94. It will be noted that, in the uppermost position of the end section 94, the center of the end section 94 projects upwardly beyond a top surface 113 on the projection 52 of the support member 16. In response to a downward force indicated diagrammatically at 114, the conductive element 24 can flex so that the end section 94 moves downwardly within the channel 64. When the downward force 114 is removed, the inherent resilience of the conductive element 24 returns the end section 94 to the position shown in FIG. 9.

Figure 10:
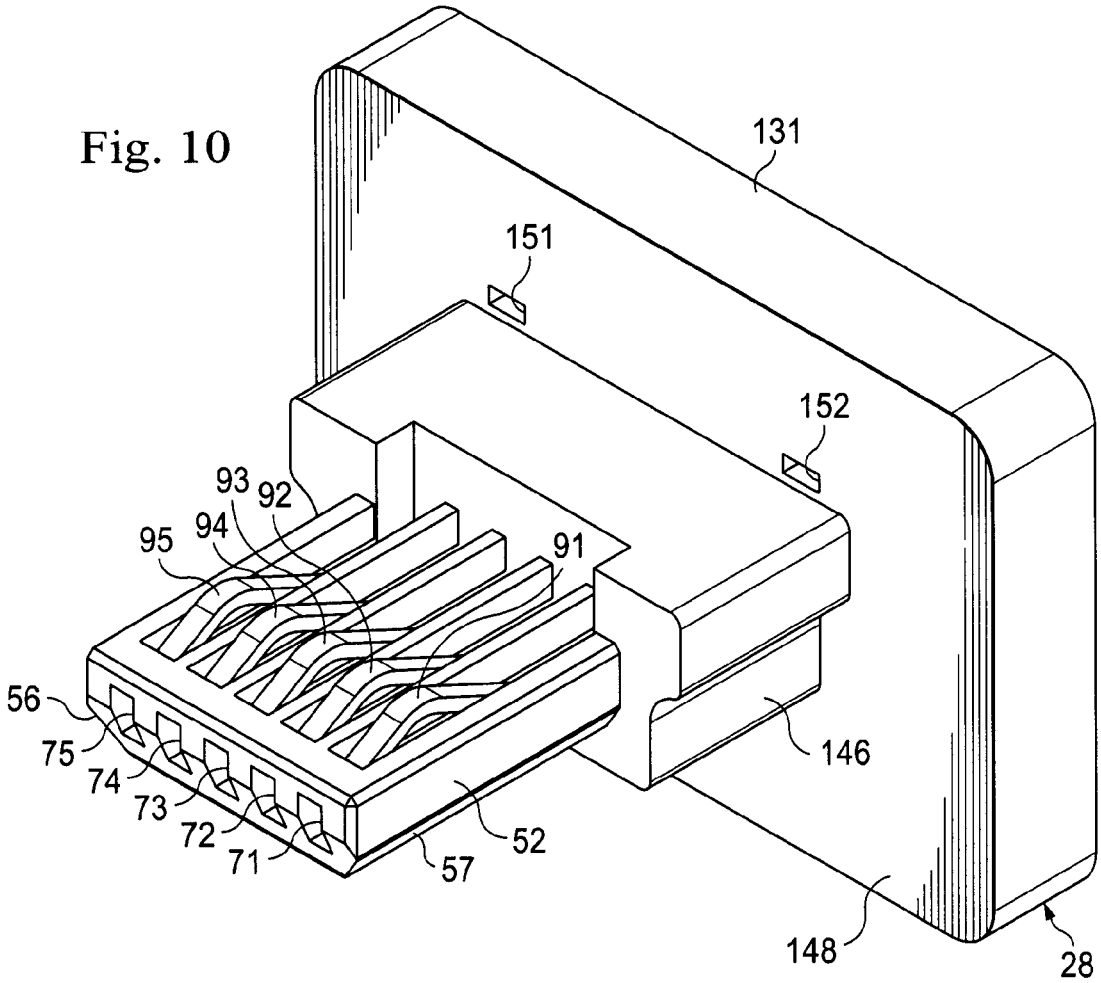
FIG. 10 is a diagrammatic perspective front view of an assembly that includes the support member and conductive elements of FIG. 7, and also an overmold that is a further component of the connector of FIG. 1.
Figure 11:
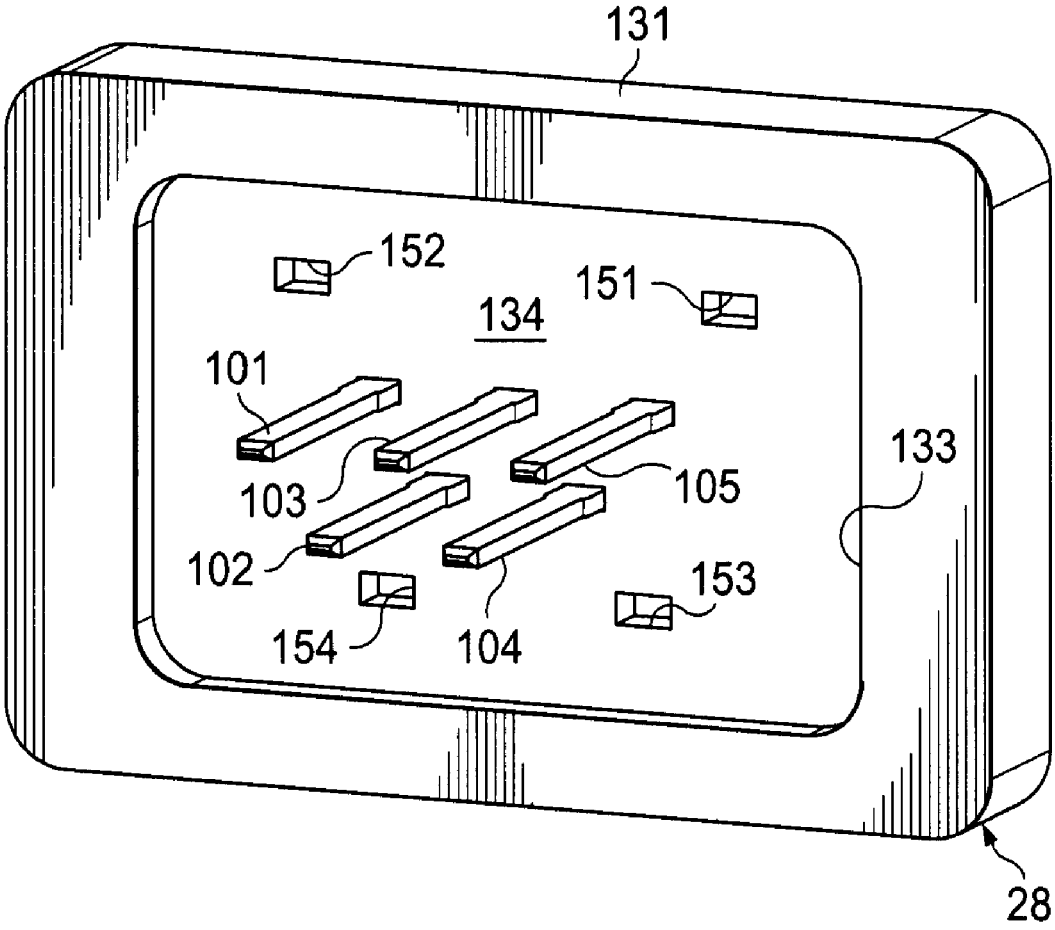
FIG. 11 is a diagrammatic perspective rear view of the assembly of FIG. 10.

After the conductive elements 21-25 have been installed in the support member 16, in order to obtain the assembly shown in FIG. 8, this assembly is placed in a not-illustrated injection mold. The cavity in the injection mold is then filled with a moldable material that is allowed to harden, and becomes the overmold 28 (FIGS. 3-4). FIG. 10 is a diagrammatic perspective front view of an assembly that includes the support member 16 and the conductive elements 21-25, with the overmold 28 formed thereon. FIG. 11 is a diagrammatic perspective rear view of the assembly of FIG. 10. In the disclosed embodiment, the overmold 28 is made from a rigid and durable plastic material of a type known in the art. However, it could alternatively be made from any other suitable material.

With reference to FIGS. 10 and 11, the overmold 28 has a platelike base 131 that is approximately rectangular, except that the corners are rounded. On its rear side, the base 131 has a shallow recess 133 (FIG. 11) that is also approximately rectangular in shape, except that its corners are rounded. The recess 133 has a planar inner end surface 134. The five conductive elements 21-25 each extend completely through the overmold 28, and their end sections 101-105 extend through the inner end surface 134 of the recess 133, and project rearwardly beyond the rear surface of the overmold.

The overmold 28 also includes a projection 146 that is integral with the base 131, and that extends forwardly from the center of the front side of the base. The projection 146 has a smaller cross-sectional size than the base 131. The base 131 has a forwardly-facing annular surface 148 that extends around the projection 146. The base 51 (FIGS. 5-6) of the support member 16 is embedded within the projection 146 of the overmold 28, and a short portion of the projection 52 of the support member is also embedded within the projection 146. The remainder of the projection 52 extends forwardly beyond the front end of the projection 146.

The end sections 91-95 of the conductive elements 21-25 are accessible in front of the overmold 28 (FIG. 10), and the opposite end sections 101-105 of the elements 21-25 are accessible behind the overmold 28 (FIG. 11). The base 131 of the overmold 28 has four small, spaced, parallel openings 151-152 extending therethrough. Each of the openings 151-154 has a rectangular cross section, opens at one end through the annular surface 148, and opens at the other end through the inner end surface 134 of the recess 133. The openings 151 and 152 are located above the projection 146, and the openings 153 and 154 are located below the projection 146.

Referring again to FIGS. 3 and 4, the shield 31 has a tubular main section 159. The opening through the main section 159 has a cross-sectional shape and size conforming closely to the cross-sectional shape and size of the projection 146 of the overmold 28. The shield 31 has four parallel legs 161-164 that project outwardly from the rear end of the main section 159. During assembly of the connector 10, the projection 146 is inserted into the opening through the main section 159 of the shield 31, and the legs 161-164 of the shield are each inserted with a force fit into a respective one of the openings through the overmold 28. In the assembled state, the outer ends of the legs 161-164 project rearwardly beyond the rear surface of the overmold 28. The overmold 28 provides a fluid seal around each of the conductive elements 21-25 and each of the legs 161-164 of the shield 31. As result, fluids and contaminants cannot pass through the overmold 28 from one side thereof to the other side along any of the conductive elements 21-25 or along any of the legs 161-164. To facilitate the fluid seal between the overmold 28 and each of the conductive elements 21-25 and each of the legs 161-164, the material used for the overmold in the disclosed embodiment has a coefficient of thermal expansion (CTE) that is approximately the same as the CTE of the conductive elements 21-25 and the legs 161-164.

On the upper side of the tubular main section 159, there are three C-shaped cutouts that each define a respective resiliently-flexible tab 167, 168 or 169. The tabs 167-169 are each bent so that a portion thereof projects downwardly a small distance into the opening through the tubular shield 31. Each of the tabs 167-169 can be flexed upwardly a small amount against the inherent resilience thereof, and the inherent resilience urges each tab to return to its original position.

As shown in FIGS. 3 and 4, the gasket 33 is platelike, and is of approximately rectangular shape, except that the corners are rounded. The gasket 33 has an opening 181 extending therethrough. The opening 181 is congruent in size and shape with the exterior of the shield 31. On the front side, the gasket 33 has a forwardly-facing annular surface 183 that extends around the opening 181. On the rear side, the gasket 33 has a rearwardly-facing annular surface 184 that extends around the opening 181. In the assembled state of the connector 10, the main section 159 of the shield 31 extends with a snug fit through the opening 181 in the gasket 33, and the annular surface 184 on the gasket 33 engages the annular surface 148 on the base 131 of the overmold 28. In the disclosed embodiment, the gasket 33 is resiliently compressible and made of silicone, but it could alternatively be made of any other suitable material.

The connector 10 has a portion that is defined by the main section 159 of the shield 31, the end sections 91-92 of the conductive elements 21-25, and the exposed part of the projection 52 on the support member 16. This portion of the connector 10 can be coupled to a standard and not-illustrated type B mini-USB connector, with the end sections 91-95 of the conductive elements 21-25 serving as electrical contacts. With reference to FIG. 1, and in a manner known in the art, an end of the not-illustrated connector is inserted into the opening through the tubular shield 31, such that a not-illustrated portion thereof is disposed between the tabs 167-169 and the top surface 113 (FIG. 9) of the projection 52. The tabs 167-169 yieldably urge this portion of the not-illustrated connector downwardly so that it slidably engages the top surface 113 of the projection 52.

Further, this portion of the not-illustrated connector has five not-illustrated electrical contacts that each slidably engage a respective one of the five electrical contacts 91-95, and that move the contacts 91-95 downwardly within the channels 61-65, by flexing the conductive elements 21-25. Each of the deflected contacts 91-95 is urged upwardly by the inherent resilience of the conductive elements, thereby ensuring a good electrical connection between each of the contacts 91-95 and the corresponding contact of the not-illustrated connector. The not-illustrated connector can later be disengaged from the connector 10, by manually pulling it out of the shield 31 of the connector 10. The contacts 91-95 then return to their original positions, due to the inherent resilience of the conductive elements 21-25.

Figure 12:
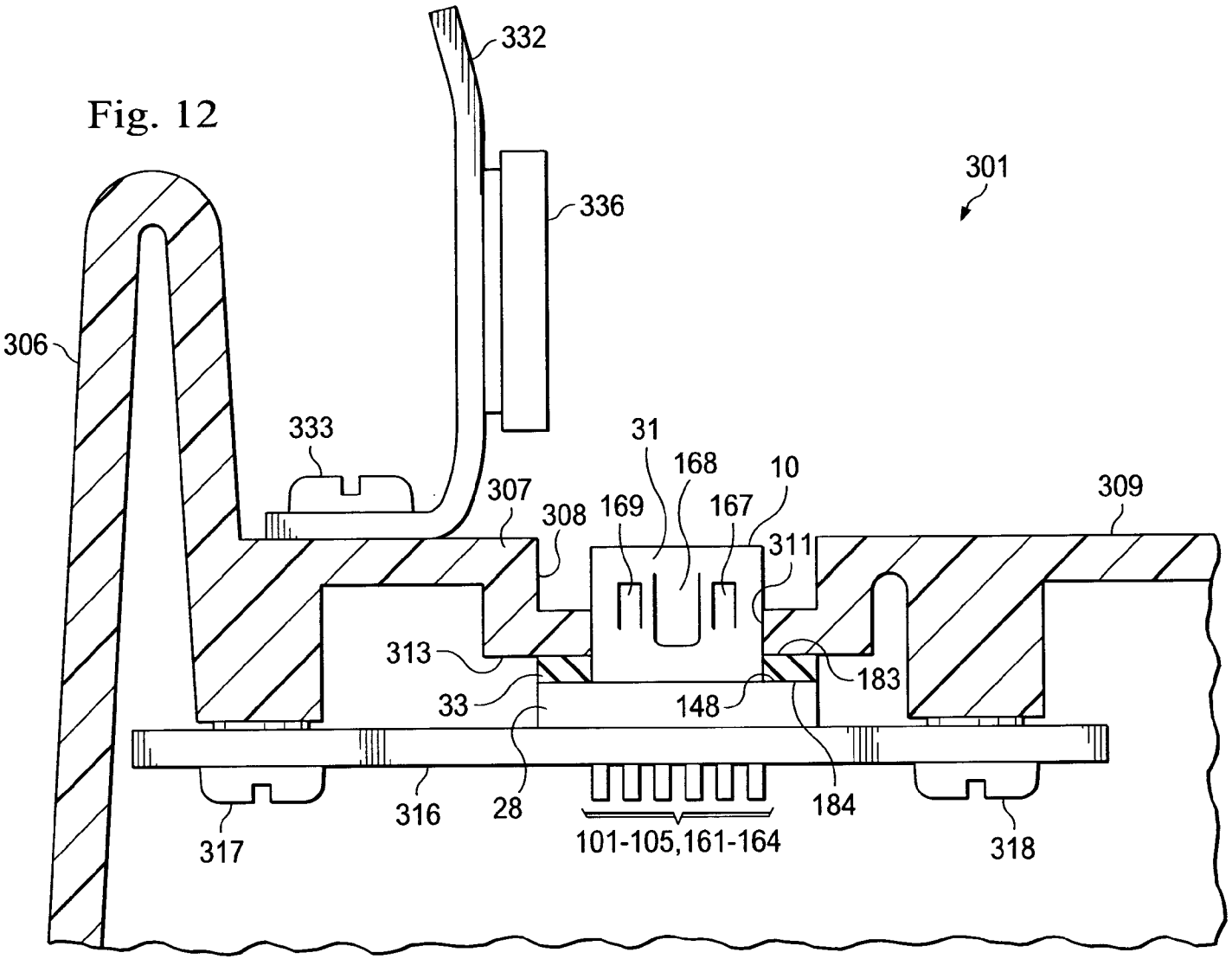
FIG. 12 is a diagrammatic fragmentary sectional view of a portion of a radio frequency identification (RFID) tag that includes the connector of FIGS. 1-11.

FIG. 12 is a diagrammatic fragmentary sectional view of part of an apparatus 301 that is a radio frequency identification (RFID) tag, and that includes the connector 10 of FIGS. 1-11. Although the apparatus 301 in FIG. 12 happens to be an RFID tag, it could alternatively be any of a variety of other types of devices. The tag 301 has a housing 306. In the disclosed embodiment, the housing 306 is made of a rigid and durable plastic material, but could alternatively be made of any other suitable material. The housing 306 has a wall 307 with an outer surface 309, and a recess 308 is provided in the surface 309 of the wall 307. An opening 311 extends from the inner end of the recess 308 through the wall 307, and opens into the interior of the housing through a surface 313 provided on the inner side of the wall 307. The opening 311 has a size that is smaller than the size of the recess 308.

A circuit board 316 is provided inside the housing 306, and is fixedly secured to the housing 306 by two or more screws 317 and 318. The screws 317 and 318 each have a threaded shank that extends through a respective opening in the circuit board 316, and that engages a respective threaded opening provided in the housing 306. The connector 10 of FIGS. 1-11 is mounted on the top side of the circuit board 316. The leads 101-105 and the legs 161-164 each extend through a respective opening provided in the circuit board 316, and project a short distance beyond the lower surface of the circuit board. The underside of the circuit board has electrically-conductive runs or traces that are not visible in the drawings, and the leads 101-105 and legs 161-164 are each soldered to a run or trace on the circuit board.

The shield 31 of the connector 10 projects upwardly through the opening 311 in the housing 306, and has its upper end disposed within the recess 308. The gasket 33 is disposed between the overmold 28 and an inner surface 313 of the housing wall 307. The annular surface 183 on the gasket 33 engages an annular portion of the inner surface 313, and the annular surface 184 of the gasket 33 engages the annular surface 148 on the overmold 28. When the circuit board 316 is snugly secured in place by the screws 317 and 318, the gasket 33 is compressed between the surface 148 on the overmold 28 and the surface 313 on the housing wall 307. As a result, the gasket 33 serves as a seal ring that provides a fluid seal around the shield 31, so as to prevent moisture, fluid or contaminants disposed outside the housing 306 from entering the housing by passing between the surfaces 313 and 148. Also, as explained earlier, fluid cannot pass through the overmold 28 from one side thereof to the other side. Thus, the overmold 28 and the gasket 33 cooperate to prevent any fluid, moisture or contaminants located outside the housing 306 from passing through the recess 308 and the opening 311, and entering the interior of the housing.

An elongate flexible strap 332 has one end fixedly secured to the housing 306 by a screw 333. The screw has a threaded shank that extends through an opening in the strap 332, and that engages a threaded opening provided in the housing. The strap 332 has an integral portion 336 that is shaped to serve as a plug. The strap 332 and plug 336 serve as a one-piece cover. The plug 336 can be removably and snugly inserted into the recess 308 in the housing 306, primarily to protect the connector 10 from possible physical damage from elements in the environment external to the housing 306, but also to provide a limited degree of sealing against dust, grease, moisture, snow, pressurized water, high humidity, and the like. The strap 332 serves as a retention element that prevents loss of the plug 336 when the plug is not in the recess 308. In the disclosed embodiment, the strap 332 and plug 336 are made from rubber which, in the disclosed embodiment is rubber with a hardness of Shore A durometer 80. However, the strap and plug could alternatively be made from any other suitable material.

With reference to FIG. 2, it would be possible to provide within the 133 a not-illustrated optional gasket that is made from a resiliently compressible material, that has nine small openings therethrough which each snugly receive a respective one of the elements 101-105 and legs 161-164, that has a thickness somewhat greater than the depth of the recess 133, and that has a peripheral edge profile conforms closely to the shape of the peripheral edge of the recess 133. When the connector 10 is mounted on and soldered to a not-illustrated circuit board, the gasket becomes compressed between the circuit board and the connector 10, thereby helping to provide a fluid seal around each of the elements 101-105 and the legs 161-164.

As yet another alternative, instead of providing a gasket within the recess 133, the recess could be filled with a not-illustrated resin or epoxy material that is commercially available and that hardens in place to help provide a fluid seal around each of the elements 101-105 and the legs 161-164. This material could, for example, be a material that bonds directly and tightly to the material of the elements 101-105 and legs 161-164.

Although a selected embodiment has been illustrated and described in detail, it should be understood that a variety of substitutions and alterations are possible without departing from the spirit and scope of the present invention, as defined by the claims that follow.

What is claimed is:

1. An apparatus comprising:

a wall portion having an opening therethrough, and having a first annular surface thereon that extends around said opening;

a circuit board;

an electrical connector supported on said circuit board, the electrical connector comprising:

a second annular surface;

a plurality of electrical contacts that each extend through said connector and have opposite ends disposed on opposite sides of said connector; and an overmold, the overmold being tightly molded around the contacts and having a coefficient of thermal expansion that is approximately equal to a coefficient of thermal expansion of the contacts, wherein:

the overmold sealingly engages the contacts to prevent fluid flow therealong through said connector;

a seal ring having third and fourth annular surfaces thereon that respectively engage said first and second annular surfaces; and structure cooperable with the wall portion and the connector in a manner compressing said seal ring between said first and second annular surfaces so that said seal ring effects a fluid seal between said first and second annular surfaces, said electrical connector and said seal ring preventing fluid flow through said opening from one side of said wall portion to the other side thereof, and said electrical contacts each having a portion that is accessible through said opening.

2. An apparatus according to claim 1, wherein said circuit board has a plurality of openings therethrough;

wherein said wall portion has a plurality of threaded openings therein that are each aligned with a respective said opening in said circuit board; and wherein said structure includes a plurality of screws that each have a threaded shank extending through a respective said opening in said circuit board and threadedly engaging a respective said threaded opening in said wall portion.

3. An apparatus according to claim 2, wherein said electrical contacts each have a portion that is soldered to said circuit board.

4. An apparatus according to claim 1, including a housing, said wall portion being part of said housing, said first annular surface being on an inner side of said wall portion, and said circuit board being disposed within an interior of said housing.

5. An apparatus according to claim 4, including a radio frequency identification tag, said housing being part of said tag.

6. An apparatus according to claim 1, including a radio frequency identification tag having a housing, said wall portion being part of said housing.

7. An apparatus according to claim 1, wherein said electrical connector is a miniature universal serial bus (USB) connector.

8. An apparatus according to claim 1, wherein the seal ring comprises a gasket through which said contacts each extend, said gasket being compressed between said circuit board and a portion of said connector so that said gasket tightly engages each said contact to effect said sealing engagement of said connector with said contacts.

9. An apparatus according to claim 1, wherein the overmold comprises a material that is one of an epoxy and a resin, and that tightly engages each said contact to effect said sealing engagement of said connector with said contacts.

10. An apparatus according to claim 9, wherein the material is bonded directly to each said contact.

11. A method of manufacturing an apparatus having a housing including an externally accessible electrical connector, comprising:

configuring a wall portion of the housing to have an opening therethrough and to have a first annular surface extending around said opening;

forming the electrical connector and coupling the electrical connector to a circuit board, wherein forming the electrical connector comprises:

tightly molding an overmold around a plurality of electrical contacts to sealingly engage the contacts to prevent fluid flow therealong through said connector, the overmold having a coefficient of thermal expansion that is approximately equal to a coefficient of thermal expansion of the contacts;

providing a seal ring having third and fourth annular surfaces that are respectively compressed between the first and second annular surfaces, the seal ring and the overmold configured to resist fluid flow from one side of said wall portion to an opposite side thereof through said opening, said electrical contacts each having a portion that is accessible through said opening.

12. A method according to claim 11, further comprising:

configuring said circuit board to have a plurality of openings therethrough;

configuring said wall portion to have a plurality of threaded openings therein that are each aligned with a respective said opening in said circuit board; and providing a plurality of screws that each have a threaded shank extending through a respective said opening in said circuit board and threadedly engaging a respective said threaded opening in said wall portion.

13. A method according to claim 12, further comprising soldering a portion of each of said electrical contacts to said circuit board.

14. A method according to claim 11, further comprising:

configuring said wall portion so that said first annular surface is on an inner side of said wall portion; and positioning said circuit board at a location disposed within an interior of said housing.

15. A method according to claim 14, including providing a radio frequency identification tag, said housing being part of said tag.

16. A method according to claim 11, including providing a radio frequency identification tag having a housing, said wall portion being part of said housing.

17. A method according to claim 11, including selecting as said electrical connector a miniature universal serial bus (USB) connector.

18. A method according to claim 11, wherein providing a seal ring comprises:

providing a gasket through which said contacts each extend; and compressing said gasket between said circuit board and a portion of said connector so that said gasket tightly engages each said contact.

19. A method according to claim 11, wherein tightly molding an overmold comprises molding the overmold from a material that is one of an epoxy and a resin, and tightly engaging each said contact.

20. A method according to claim 19, further comprising bonding said material directly to each said contact.

* * * * *